US007370499B1

(12) United States Patent
Lee

(10) Patent No.: US 7,370,499 B1
(45) Date of Patent: May 13, 2008

(54) DUAL-MODE LOCK WITH A COMBINATION IDENTIFICATION FUNCTION

(75) Inventor: Miko Lee, Hsinchuang (TW)

(73) Assignee: ABA UFO International Corp., Taipei Hsien (TW)

( * ) Notice: Subject to any disclaimer, the term of this patent is extended or adjusted under 35 U.S.C. 154(b) by 0 days.

(21) Appl. No.: 11/723,032

(22) Filed: Mar. 16, 2007

(30) Foreign Application Priority Data

Jan. 5, 2007 (TW) ..... 96100466 A

(51) Int. Cl.
*E05B 69/00* (2006.01)

(52) U.S. Cl. ..... 70/58; 70/14; 70/284; 70/285

(58) Field of Classification Search ..... 70/14, 70/18, 57, 58, 30, 49, 284, 285, 21
See application file for complete search history.

(56) References Cited

U.S. PATENT DOCUMENTS 5,388,434 A * 2/1995 Kalis ..... 70/58
5,913,907 A * 6/1999 Lee ..... 70/58
6,058,744 A * 5/2000 Ling ..... 70/28
6,449,992 B1 * 9/2002 Yu et al. ..... 70/58
6,463,770 B1 * 10/2002 Lee ..... 70/58
6,508,089 B1 * 1/2003 Tsai ..... 70/213
6,523,373 B1 * 2/2003 Su ..... 70/58
6,536,244 B1 * 3/2003 Chang ..... 70/58
6,619,080 B1 * 9/2003 Yu ..... 70/58
6,619,081 B1 * 9/2003 Yu ..... 70/58
6,672,117 B2 * 1/2004 Yu ..... 70/58
6,931,894 B2 * 8/2005 Yu ..... 70/18
6,968,716 B1 * 11/2005 Ling ..... 70/14
6,973,809 B2 * 12/2005 Chang ..... 70/58
7,073,358 B1 * 7/2006 Lee ..... 70/58
7,076,977 B2 * 7/2006 Lee ..... 70/58
7,111,479 B2 * 9/2006 Murray et al. ..... 70/58
7,140,210 B2 * 11/2006 Cheng ..... 70/58
7,185,518 B1 * 3/2007 Huang ..... 70/14
7,296,446 B1 * 11/2007 Miao et al. ..... 70/14
2003/0106349 A1 * 6/2003 Broadbridge et al. ..... 70/58
2006/0123857 A1 * 6/2006 Ling et al. ..... 70/21
2006/0272368 A1 * 12/2006 Yu ..... 70/58
2007/0125138 A1 * 6/2007 Miao ..... 70/58
2007/0157681 A1 * 7/2007 Miao ..... 70/58
2007/0175247 A1 * 8/2007 Yu ..... 70/58

* cited by examiner

*Primary Examiner*—Suzanne Dino Barrett
(74) *Attorney, Agent, or Firm*—Bacon & Thomas, PLLC

(57) ABSTRACT

A dual-mode lock with a combination identification function has a combination mechanism and a cylinder mechanism. The combination mechanism has multiple wheel assemblies. Each wheel assembly has an identification notch formed at a specific position corresponding to a combination number of the wheel assembly. The cylinder mechanism has an actuating shaft that is unlocked and rotated by an operating key. Additionally, the actuating shaft moves an access panel that has multiple aligning holes to align the aligning holes respectively with the identification notches. Consequently, a user can easily identify the combination of the dual-mode lock by insertion of a simple detecting tool.

6 Claims, 6 Drawing Sheets

DUAL-MODE LOCK WITH A COMBINATION IDENTIFICATION FUNCTION

BACKGROUND OF THE INVENTION

1. Field of the Invention

The present invention relates to a lock, and more particularly to a dual-mode lock with a combination identification function that enables a combination to be identified with a simple detecting tool and a simple procedure.

2. Description of Related Art

Locks are used to prevent articles from being stolen, and different locks have been developed for specific purposes. For example, one type of lock securely attaches notebook computers to a stationary object.

Such locks have protruding latches that attach to corresponding latching holes in notebook computers and are generally actuated by inserting and turning a key. However, the keys are susceptible to being lost, which makes the locks inconvenient to use. Consequently, dual-mode locks have been developed to allow the lock to be unlocked with a key or by dialing a combination.

However, the dual-mode locks tend to be structurally complicated and very large. Furthermore, techniques to determine forgotten combinations are extremely difficult, at best, and are virtually impossible for ordinary users of combination locks.

To overcome the shortcomings, the present invention provides a dual-mode lock with a combination identification function to obviate or mitigate the aforementioned problems.

SUMMARY OF THE INVENTION

The main objective of the present invention is to provide a dual-mode lock with a combination identification function, which has a simple structure and is compact. Moreover, the dual-mode lock in accordance with the present invention allows a forgotten combination to be identified with a simple detecting tool (such as a detecting rod) and a simple procedure.

To achieve the objective, the dual-mode lock in accordance with the present invention comprises a housing, a latch, a cylinder mechanism and a combination mechanism mounted in the housing.

The latch protrudes from the housing, can attach to a corresponding latching hole in a notebook computer and is actuated by the combination mechanism or the cylinder mechanism to fasten the computer to a stationary object.

The combination mechanism has multiple wheel assemblies mounted rotatably in the housing. Each wheel assembly has a specific combination number and an identification notch combination number hole formed in the wheel assembly at a specific angle corresponding the combination number and selectively aligning with a identification hole formed in the housing when the wheel assembly is rotated.

The cylinder mechanism has an actuating shaft that is controlled with a corresponding key to actuate the latch and move an access panel in the housing. The access panel is mounted between the wheel assemblies and the identification holes in the housing and has access holes.

The access holes align respectively with the identification holes when the access panel is moved to allow the detecting tool to pass sequentially the identification holes and the access holes. The wheel assembly is turned until the identification notch aligns with the identification hole and the access hole at which point the detecting tool slides into the combination number hole thereby revealing the combination number for the specific wheel assembly. The process is repeated for each wheel assembly to identify the combination of the dual-mode lock.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
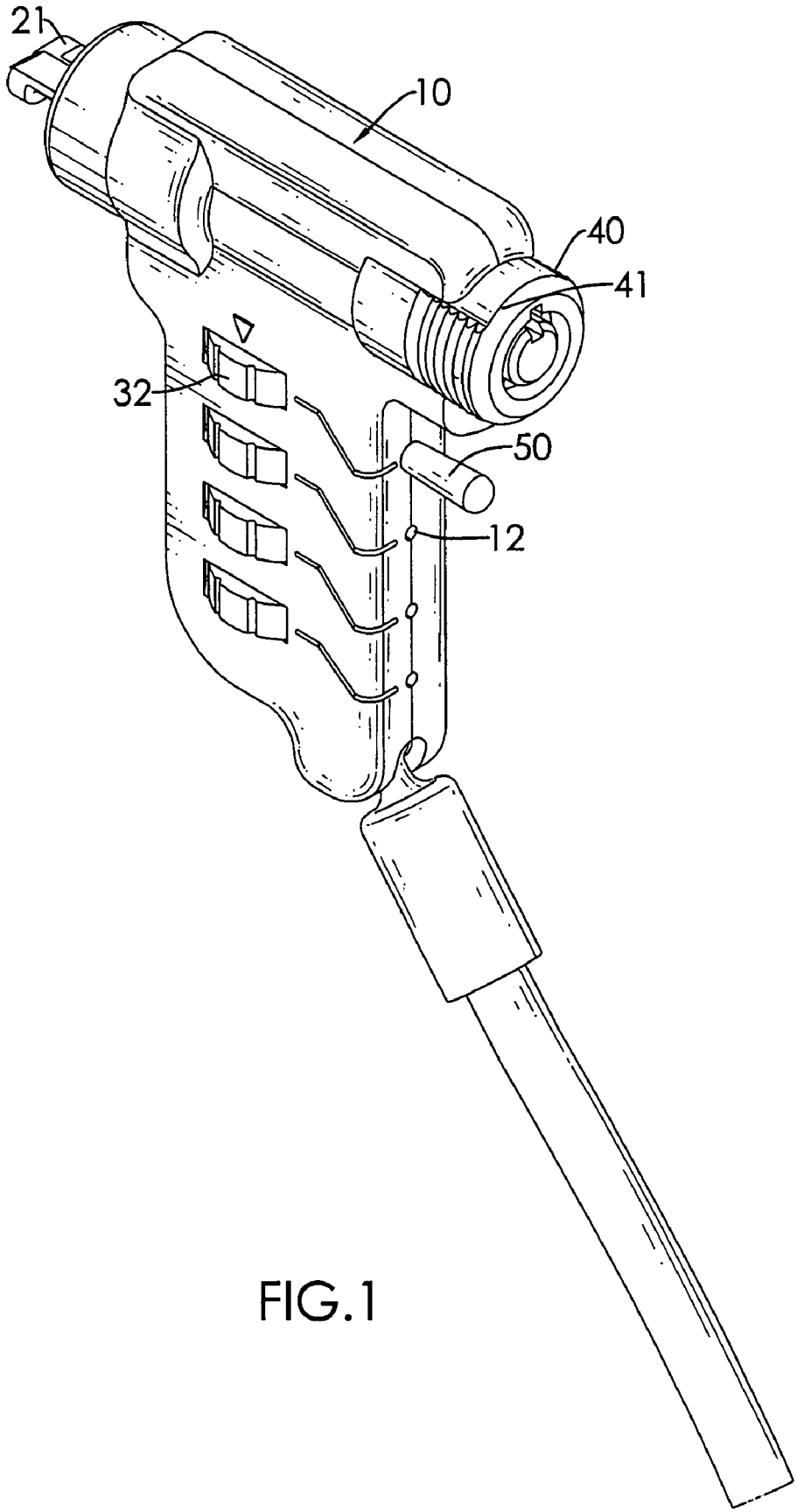
FIG. 1 is a perspective view of a dual-mode lock with combination identification function in accordance with the present invention.
Figure 2:
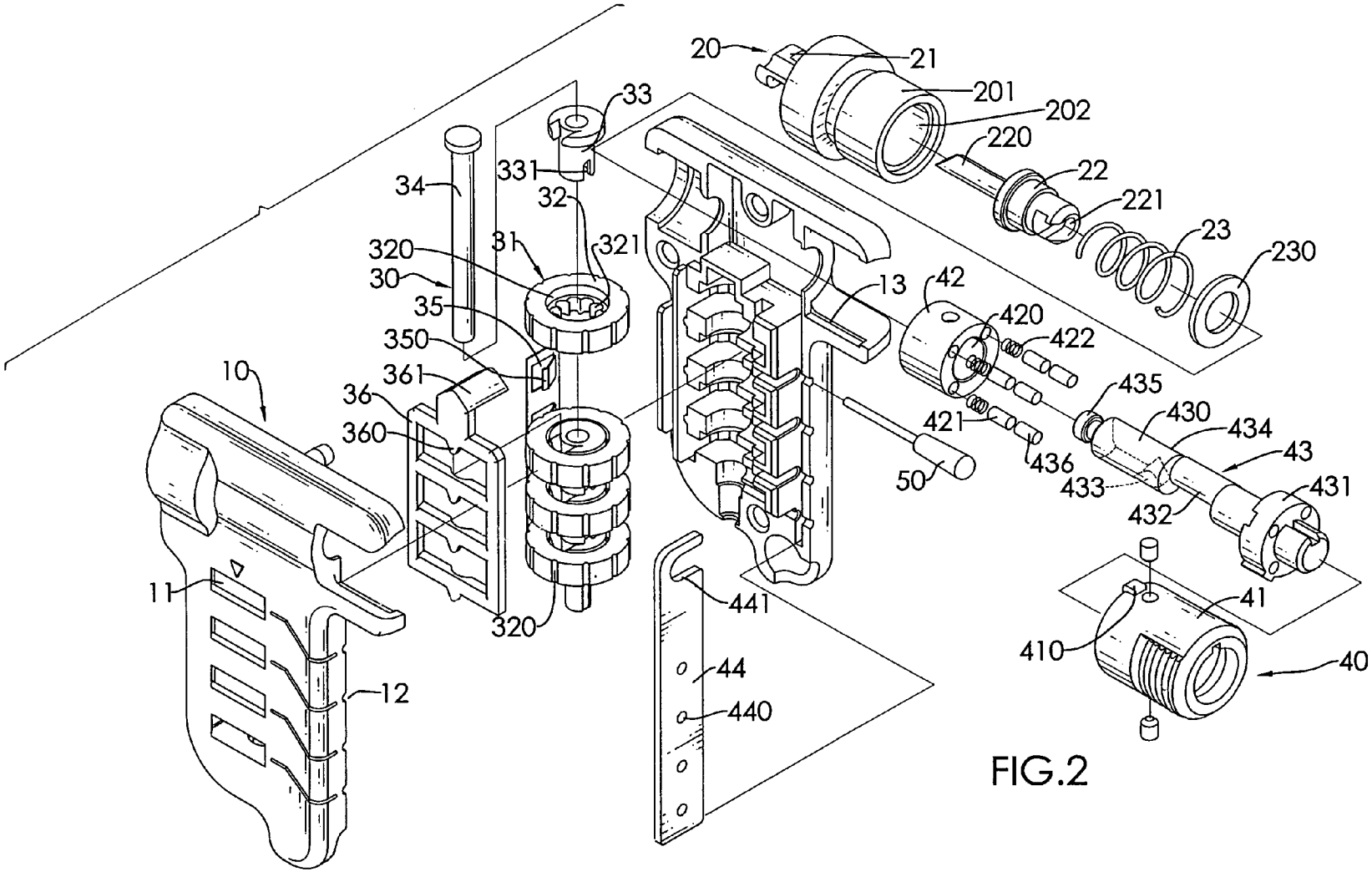
FIG. 2 is an exploded perspective view of the dual-mode lock in FIG. 1.

With reference to FIGS. 1 and 2, a dual-mode lock in accordance with the present invention comprises a housing (10), a latching assembly (20), a combination mechanism (30), a cylinder mechanism (40) and an optional detecting rod (50).

The housing (10) comprises two halves and has a front, a rear, an outer surface, multiple identification holes (12), a latch chamber, a wheel chamber and a cylinder recess.

The two halves attach to each other to form the housing (10), and each half has an outer surface and multiple openings (11). The openings (11) are formed through the outer surface and are in line with each other, and the openings (11) in opposite halves align respectively with the openings (11) in the other half.

The identification holes (12) are formed through the rear of the housing (10) in a line.

The latch chamber has an inner surface and a rear end.

The wheel chamber corresponds to the openings (11) in the halves of the housing (10) and has multiple wheel recesses and multiple tool holes. The wheel recesses align and communicate with the openings (11) in the halves of the housing (10). The tool holes communicate respectively with the wheel recesses and align respectively with the identification holes (12) in the housing (10).

The cylinder recess is formed on the rear of the housing (10) in line with the latch chamber and has a top surface, a bottom surface, two guide slots (13) and a limiting recess.

The guide slots (13) are formed longitudinally respectively in the top and the bottom surfaces.

The latching assembly (20) is mounted in the latch chamber of the housing (10) and comprises a holding bracket (201), a latch (21), an actuating element (22), an optional washer (230) and a spring (23).

The holding bracket (201) is mounted securely in the latch chamber of the housing (10) and has a front end and a holding space (202). The holding space (202) is formed longitudinally inside the holding bracket (201).

The latch (21) is mounted rotatably in the front end of the holding bracket (201), protrudes from the front of the housing (10) and has a distal end, a locking flange (210) and two locking grooves (211). The locking flange (210) is formed on the distal end of the latch (21) and has two ends. The locking grooves (211) are formed longitudinally in the latch (21) opposite to each other and pass through the locking flange (210) respectively near the ends.

Figure 3:
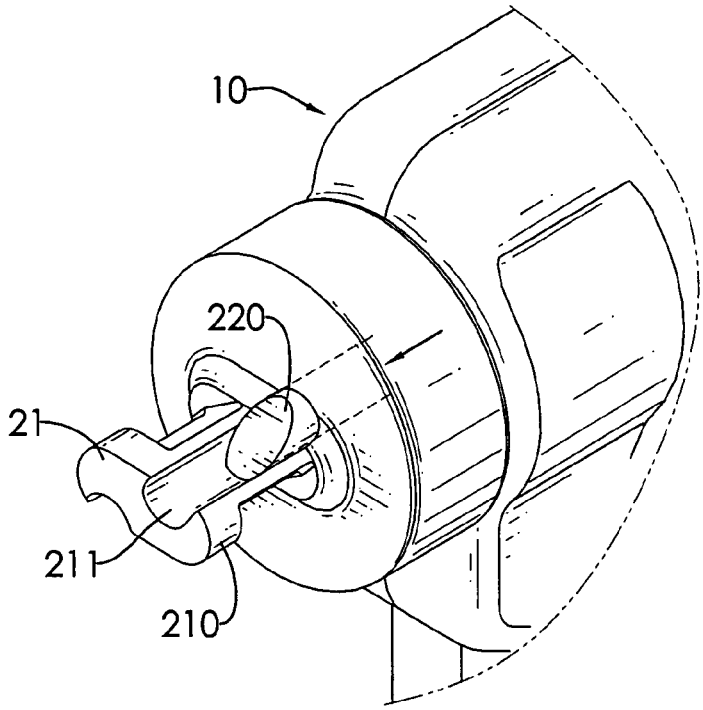
FIG. 3 is an enlarged operational perspective view of the dual-mode lock in FIG. 1 with an actuating rod extending into a groove in the latch.
Figure 4:
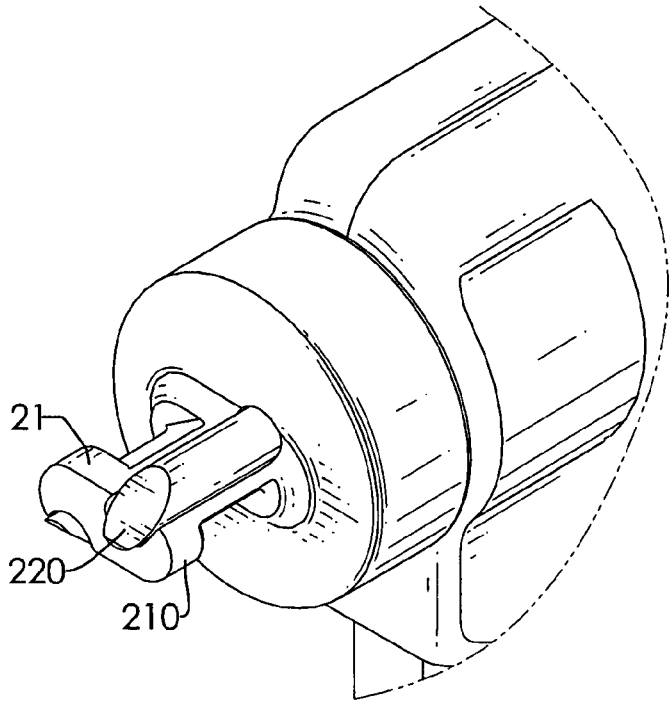
FIG. 4 is an enlarged operational perspective view of the dual-mode lock in FIG. 1 with the actuating rods extended fully into the groove in the latch to keep the latch from rotating.

With further reference to FIGS. 3 and 4, the actuating element (22) is mounted movably in the holding space (202) in the holding bracket (201) and has a proximal end, a distal end, a connecting recess (221) and two actuating rods (220). The connecting recess (221) is formed in the proximal end of the actuating element (22). The actuating rods (220) are formed on and protrude longitudinally from the distal end of the actuating element (22) and are mounted slidably respectively in the locking grooves (211) in the latch (21), and each actuating rod (220) has an inclined distal end. The actuating rods (220) cause the locking flange (210) on the latch (21) to rotate in a corresponding latching hole to lock the dual-mode lock in place when the inclined distal ends of the actuating rods (220) slide completely to the distal end of the latch (21). Retracting the actuating rods (220) allows the latch (21) to be rotated and the locking flange (210) to be removed from the latching hole.

The washer (230) is mounted in the latch chamber against the inner surface at the rear end of the latch chamber.

The spring (23) is mounted in the latch chamber, presses the actuating element (22) forward and has a rear end and a front end. The rear end abuts the latch chamber and may abut the washer (230). The front end is mount securely around the proximal end of the actuating element (22).

Figure 5:
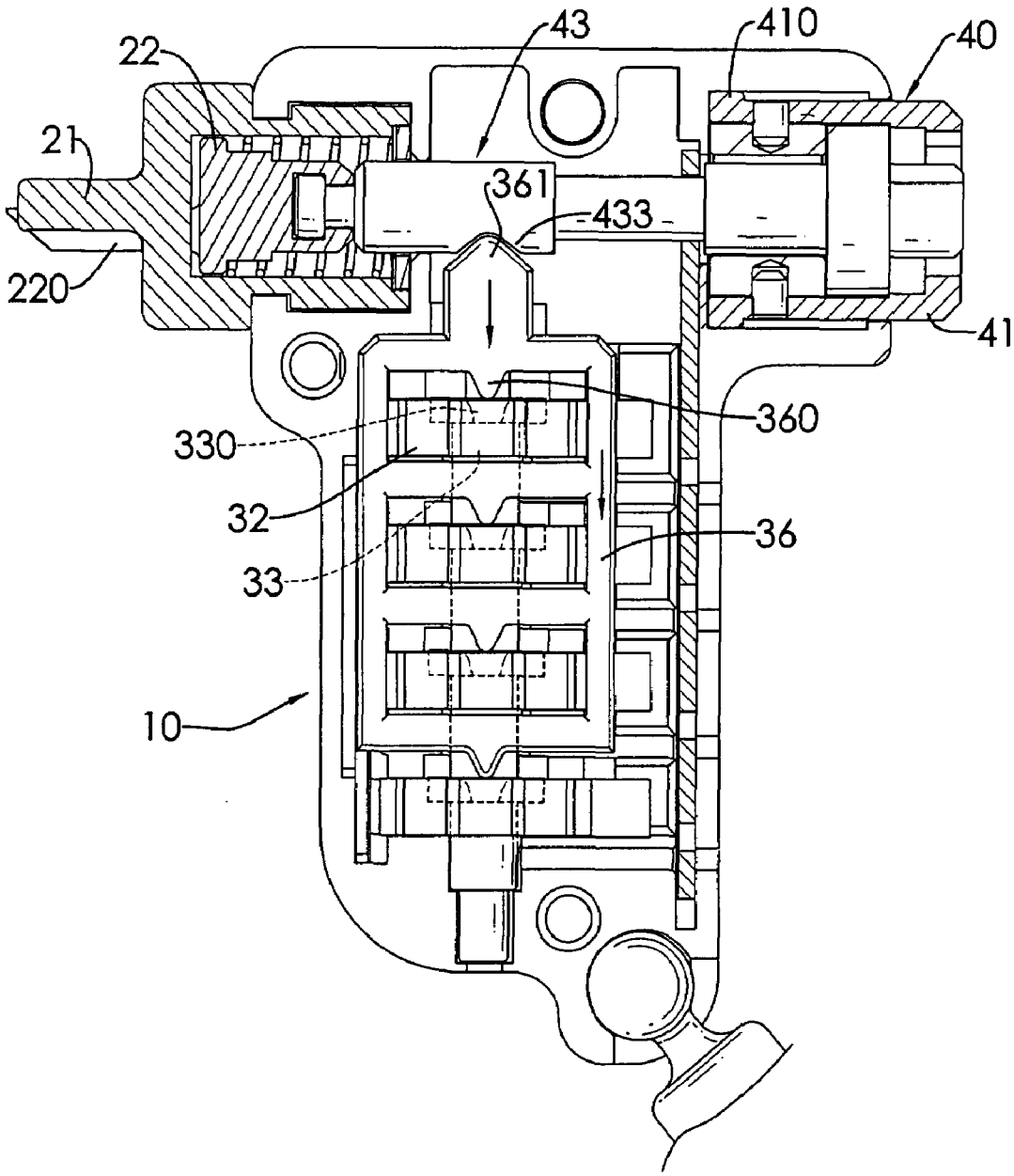
FIG. 5 is an operational side view in partial section of the dual-mode lock in FIG. 1 with the locking protrusions aligned with and extending into the combination notches in the wheel brackets.
Figure 6:
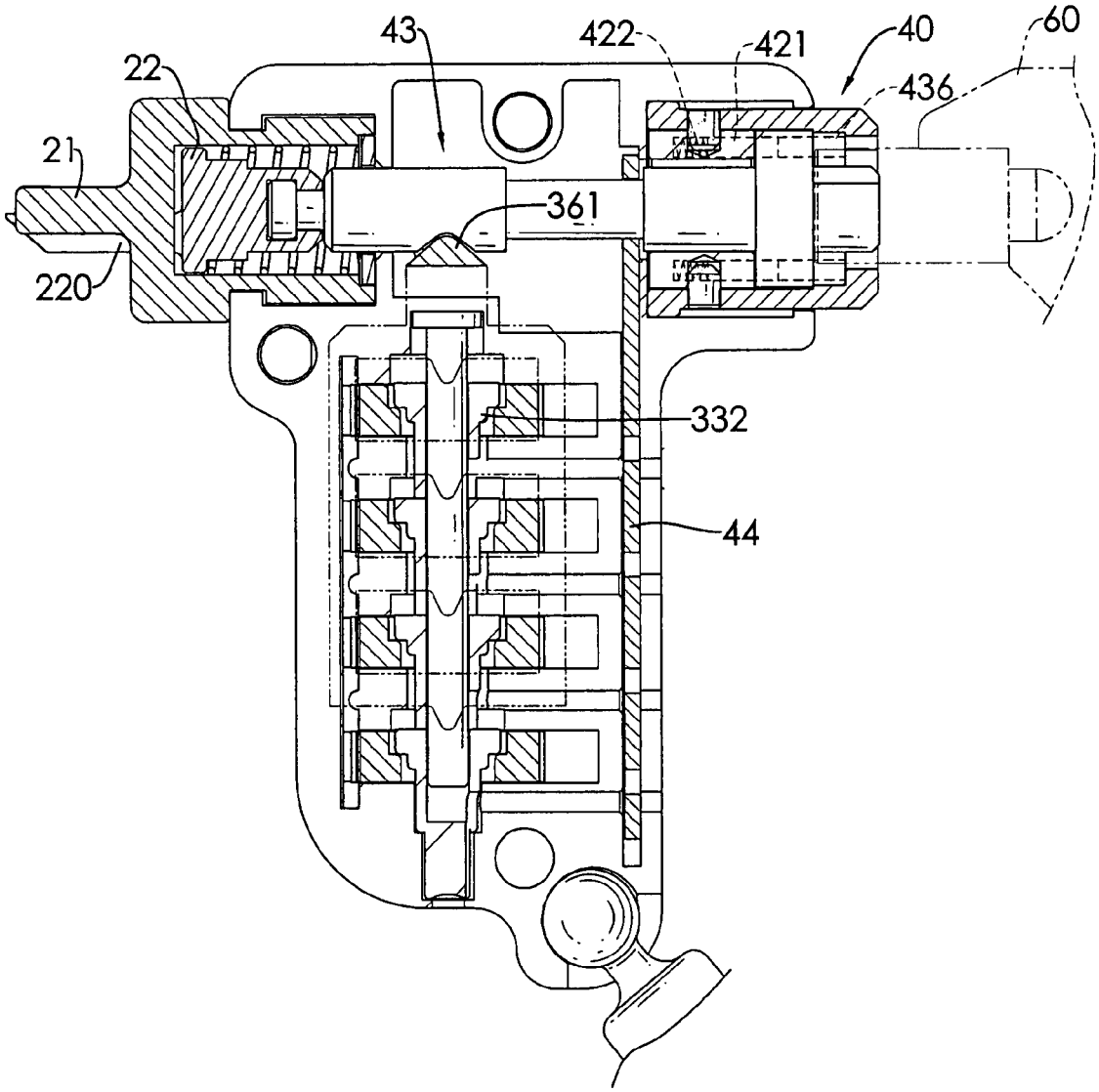
FIG. 6 is an operational side view in partial section of the dual-mode lock in FIG. 1 with a key inserted into the keyhole.

With further reference to FIGS. 5 and 6, the combination mechanism (30) is mounted in the wheel chamber of the housing (10) and comprises a pintle (34), multiple wheel assemblies (31), multiple resilient detents (35) and a latching bar latch (36).

The pintle (34) is securely mounted longitudinally in the wheel chamber.

The wheel assemblies (31) are mounted rotatably on the pintle (34) respectively in the wheel recesses and correspond respectively to the openings (11) of the housing (10). Each wheel assembly (31) includes a wheel (32) and a wheel bracket (33).

The wheel (32) has an outer edge, a central hole (320), multiple flutes (320) and multiple teeth (321). The central hole (320) is formed through the wheel (32) and has an inner edge. The flutes (320) are formed around the outer edge of the wheel (32) and divide the outer edge into equal segments. Each segment has a unique number. The teeth (321) are formed on and protrude in from the inner edge of the central hole (320).

The wheel brackets (33) are tubular, are mounted rotatably on the pintle (34) and correspond respectively to and hold the wheels (32), and each wheel bracket (33) has a top, a bottom, a flange, a combination notch (330), an identification notch (331) and multiple retaining teeth (332). The flange is formed on and protrudes radially out from the top of the wheel bracket (33) and is mounted in the central hole (32) in the wheel (32) on the teeth (321). The combination notch (330) is formed in the flange (33) and corresponds to the number on the adjacent segment of the outer edge of the wheel (32). The identification notch (331) is formed in the bottom of the wheel bracket (33) at a specific position relative to the number on the segment of the outer edge of the wheel (32) adjacent to the combination notch (330) and aligns with the corresponding identification hole (12) in the housing (10) when the number is exposed in the opening (11) of the housing (10). The retaining teeth (332) are formed around the wheel bracket (33) below the flange and engage the teeth (321) in the central hole (320) of the wheel (32) such that the number corresponding to the combination notch (330) can be changed easily.

The resilient detents (35) are mounted securely in the wheel chamber of the housing (10) adjacent respectively to the wheels (32) and engage the flutes (320) on the wheels (32) to hold the wheels (32) in position. Each resilient detent (35) has an inner end (350). The inner end (350) abuts and slides on the outer edge of the wheel (32) and engages the flutes (320) to hold the number on the wheel (32) squarely in the corresponding opening (11).

The latching bar latch (36) is mounted slidably in the wheel chamber, moves longitudinally relative to the wheel assemblies (31) and has a top, multiple cutouts, multiple locking protrusions (360) and a latching arm (361). The cutouts are formed through the latching bar latch (36), correspond respectively to the wheels (32) and allow the wheels (32) to protrude through the latching bar latch (36) respectively into the openings (11), and each cutout has a top edge. The locking protrusions (360) are formed respectively on and protrude down from the top edges of the cutouts of the latching bar latch (36), press against the flange on the wheel bracket (33) and hold the latching bar latch (36) up unless all the combination notches (330) are aligned respectively with the locking protrusions (360), in which case the latching bar latch (36) will move down. The latching arm (361) is formed at and protrudes transversely from the top of the latching bar latch (36).

The cylinder mechanism (40) is mounted in the cylinder recess in the housing (10) and comprises a pull knob (41), a stationary cylinder (42), an actuating shaft (43), an operating key (60) and an access panel (44).

The pull knob (41) is hollow and has an outer end, a top, a bottom, a keyhole, two keys (410), two pinholes and a receiving space. The keyhole is formed in the outer end of the pull knob (41). The keys (410) are formed respectively on the top and the bottom of the shell and are mounted slidably respectively in the guide slots (13) of the latch chamber of the housing (10) to allow the pull knob (41) to slide in the cylinder recess. The pinholes are formed respectively through the top and the bottom of the pull knob (41) longitudinally adjacent respectively to the keys. The receiving space is formed inside the pull knob (41).

The stationary cylinder (42) is hollow, is mounted securely inside the pull knob (41) and has two mounting recesses, two connecting pins, an outer end surface, a center hole (420), multiple bores, multiple tumbler springs (422) and multiple tumbler pins (421). The mounting recesses are formed in the stationary cylinder (42) and correspond respectively to the pinholes in the pull knob (41). The connecting pins are mounted respectively through the pinholes in the pull knob (41) and in the mounting recesses in the stationary cylinder (42) to hold the stationary cylinder (42) in the pull knob (41). The central hole (320) is defined longitudinally through the stationary cylinder (42). The bores are formed separately in the outer end surface. The tumbler springs (422) are mounted respectively in the bores. The tumbler pins (421) are mounted respectively in the bores on the tumbler springs (422).

The actuating shaft (43) is mounted rotatably inside the pull knob (41), extends through the center hole (420) in the stationary cylinder (42) and comprises an outer end, a rotating cylinder (431), an eccentric segment (432), a concentric segment (430) and an inner connector (435).

The rotating cylinder (431) is formed radially on the outer end of the actuating shaft (43), is coaxial with and abuts the stationary cylinder (42) and comprises an outer surface, two ends, a stop, multiple pinholes, a key post and a connecting rod. The stop is formed longitudinally on and protrudes out from the outer surface of the rotating cylinder (431) and is mounted movably in the limiting recess in the cylinder recess to limit how much the actuating shaft (43) will rotate. The pinholes are formed longitudinally through the rotating cylinder (431) around the actuating shaft (43) and correspond respectively to the pinholes in the stationary cylinder (42). Each pinhole has a lock pin (436). The lock pins (436) are mounted slidably respectively in the pinholes in the rotating cylinder (431) and correspond respectively to and are pushed respectively by the tumbler pins (421). The key post is formed coaxially on and protrudes out from one of the ends of the rotating cylinder (431), extends through the keyhole in the pull knob (41) and has an alignment groove formed longitudinally in the key post. The connecting rod is formed coaxially on and protrudes from the end of the rotating cylinder (431) opposite to the key post and has an end.

The eccentric segment (432) is formed eccentrically on the end of the connecting rod and has an inner end.

The concentric segment (430) is formed on and protrudes longitudinally from the inner end of the eccentric segment (432) coaxial with the rotating cylinder (431) and has a bottom surface, a side, a latching recess (433) and a longitudinal flat (434). The latching recess (433) is formed in the bottom surface and is engaged by the latching arm (361) of the latching bar latch (36) when the latching bar latch (36) moves upward to lock the actuating shaft (43) in place. The longitudinal flat (434) is formed in the side of the concentric segment (430), communicates with the latching recess (433) and allows the actuating shaft (43) to slide out and pull the actuating rods (220) away from the latch (21) when the actuating shaft (43) is rotated so the latching arm (361) disengages from the latching recess (433) and aligns with the longitudinal flat (434).

The inner connector (435) is formed coaxially on and protrudes from the concentric segment (430), extends through the center hole (420) in the stationary cylinder (42) and engages the connecting recess (221) in the actuating element (22).

Figure 7:
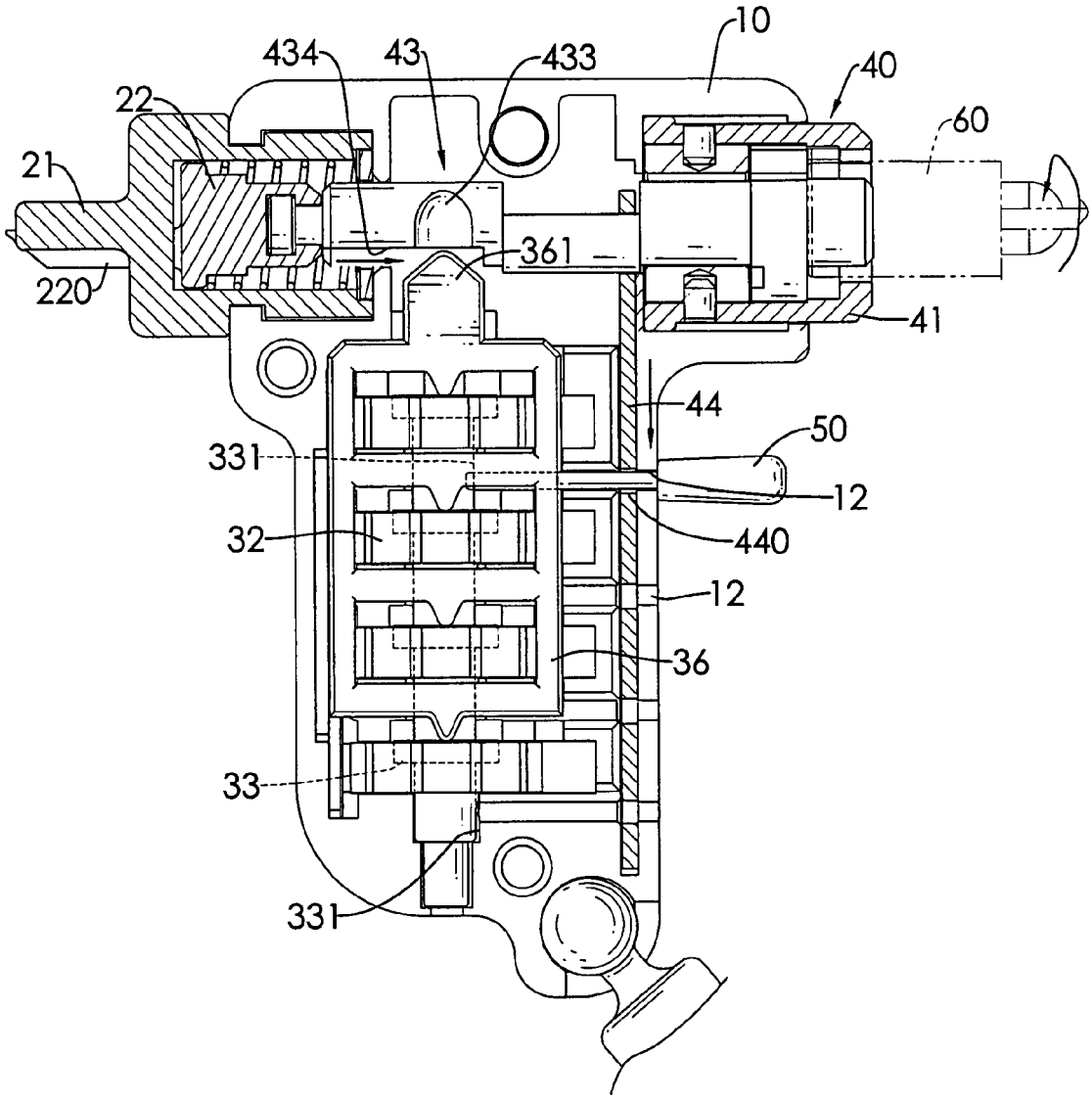
FIG. 7 is an operational side view in partial section of the dual-mode lock in FIG. 1 with a detecting rod inserted sequentially into a identification hole, an aligning hole and an identification notch.

With further reference to FIG. 7, the operating key (60) is a convention tubular key, unlocks the dual-mode lock, enables the combination identification function and has a tubular shaft and a tab. The tubular shaft has an inner end, an outer end and multiple pin recesses. The pin recesses are formed longitudinally in the inner end and are different lengths corresponding respectively to lengths of the locking pins (436) in the rotating cylinder (431) and engage and press the locking pins (436) to allow the rotating cylinder (431) and the actuating shaft (43) to rotate. The tab is formed on and protrudes longitudinally from the outer end of the tubular shaft.

The access panel (44) is mounted slidably between the wheel assemblies (31) and the identification holes (12) in the housing (10) and has a top end, multiple aligning holes (440) and a connecting notch (441). The aligning holes (440) are formed through the access panel (44) and selectively align respectively with the identification holes (12) when the access panel (44) is moved. The connecting notch (441) is formed in the top end of the access panel (44), engages the eccentric segment (432) of the actuating shaft (43) and causes the access panel (44) to move when the actuating shaft (43) is rotated.

The detecting rod (50) is used to identify the combination of the dual-mode lock and has an outer end, a knob and an inner end. The knob is formed on the outer end. To identify the combination of the dual-mode lock, the inner end of the detecting rod (50) is pressed through an identification hole (12), an aligned aligning hole (440) through the access panel (44) and a corresponding tool hole in a wheel recess in the wheel chamber and is pressed against the corresponding wheel bracket (33). When the wheel (32) is turned, the inner end of the detecting rod (50) enters the identification notch (331) and stops the wheel from turning so the combination number for that particular wheel (32) can be read in the corresponding opening (11) in the housing (10).

The dual-mode lock as described has the advantages of being able to be operated with a key (60) or a combination and being able to identify a lost or forgotten combination easily and quickly.

Even though numerous characteristics and advantages of the present invention have been set forth in the foregoing description together with details of the structure and function of the invention, the disclosure is illustrative only. Changes may be made in detail especially in matters of shape, size and arrangement of parts within the principles of the invention to the full extent indicated by the broad general meaning of the terms in which the appended claims are expressed.

What is claimed is:

1. A dual-mode lock comprising a housing including two halves attaching to each other to form the housing, and each half having an outer surface and the housing having a front;

a rear;

an outer surface;

a latching assembly being mounted in the housing and comprising a latch being mounted rotatably in the front end of a holding bracket and protruding from the front of the housing; and an actuating element being mounted movably in a holding space and having two actuating rods to actuate the latch when the actuating element being moved;

a combination mechanism being mounted in the housing and comprising a pintle;

multiple wheel assemblies being mounted rotatably on the pintle respectively, and each wheel assembly including a wheel having an outer edge;

multiple numbers formed around the outer edge;

a central hole being formed through the wheel and having an outer edge;

a wheel bracket being tubular and being mounted rotatably on the pintle, the wheel brackets corresponding respectively to and holding the wheels, and each wheel bracket having a bottom;

an identification notch being formed in the bottom of the wheel bracket at a specific position relative to the number on the outer edge of the wheel; and a combination notch corresponding to the number on the outer edge of the wheel;

a latching bar latch being mounted slidably in the housing and moving longitudinally relative to the wheel assemblies and having a top;

multiple cutouts being formed through the latching bar latch, corresponding respectively to the wheels and allowing the wheels to protrude through latching bar latch respectively, and each cutout having a top edge;

multiple locking protrusions being formed respectively on and protruding down from the top edges of the cutouts of the latching bar latch, pressing against the wheel bracket and holding the latching bar latch up unless all the combination notches are aligned; and a latching arm being formed at and protruding transversely from the top of the latching bar latch; and a cylinder mechanism being mounted in the housing and comprising a pull knob being hollow and being slidably mounted in the housing and having an outer end, a keyhole being formed in the outer end of the pull knob; and a receiving space being formed inside the pull knob;

a stationary cylinder being hollow, being mounted securely inside the pull knob and having a center hole being defined longitudinally through the stationary cylinder;

an actuating shaft being mounted rotatably inside the pull knob, extending through the center hole in the stationary cylinder and comprising an outer end;

a rotating cylinder being formed radially on the outer end of the actuating shaft, being coaxial with and cooperating with the stationary cylinder to provide a lock function and comprising two ends; and a connecting rod being coaxially on and protruding from the one of the ends of the rotating cylinder and having an end;

an eccentric segment being formed eccentrically on the end of the connecting rod and having an end;

a concentric segment being formed on and protruding longitudinally from the inner end of the eccentric segment coaxial with rotating cylinder and having a bottom surface, a side, a latching recess being formed in the bottom surface and being engaged by the latching arm of the latching bar latch when the latching bar latch moves upward; and a longitudinal flat being formed in the side of the concentric segment, communicating with the latching recess and allowing the actuating shaft to slide out; and an inner connector being formed coaxially on and protruding from the concentric segment and engaging the actuating element; and an access panel being mounted slidably in the housing and having a top end;

multiple aligning holes being formed through the access panel and selectively aligning respectively with the identification notches; and a connecting notch being formed in the top end of the access panel, engaging the eccentric segment of the actuating shaft and causing the access panel to move when the actuating shaft is rotated.

2. The dual-mode lock as claimed in claim 1, wherein the housing further has a latch chamber having an inner surface; and a rear end;

a wheel chamber in the halves of the housing and having multiple wheel recesses; and a cylinder recess being formed on the rear of the housing in line with the latch chamber;

the latching assembly is mounted in the latch chamber of the housing;

the pintle of the combination mechanism being securely mounted longitudinally in the wheel chamber of the housing;

the wheel assemblies of the combination mechanism being respectively in the wheel recesses, the latching bar latch being mounted slidably in the wheel chamber of the housing; and the pull knob being slidably mounted in the cylinder recess.

3. The dual-mode lock as claimed in claim 2, wherein each wheel further has multiple teeth being formed on and protruding in from the inner edge of the central hole; and each wheel bracket further has a top;

a flange being formed on and protrudes radially out from the top of the wheel bracket and being mounted in the central hole in the wheel on the teeth; and multiple retaining teeth being formed around the wheel bracket below the flange and engaging the teeth in the central hole of the wheel.

4. The dual-mode lock as claimed in claim 2, wherein each wheel further has multiple flutes being formed around the outer edge of the wheel and dividing the outer edge into equal segments, each segment having a unique number; and the combination mechanism further has multiple resilient detents being mounted securely in the wheel chamber of the housing adjacent respectively to the wheels and each resilient detent having an inner end abutting and sliding on the outer edge of the wheel and engaging the flutes to hold the wheels in position.

5. The dual-mode lock as claimed in claim 4, wherein the housing further has multiple openings formed through the outer surface; and multiple identification holes being formed through the rear of the housing in a line;

the wheel recesses aligning and communicating with the openings and the identification holes in the halves of the housing; and the wheel assemblies corresponding respectively to the openings of the housing.

6. The dual-mode lock as claimed in claim 2, further comprises a detecting rod used to identify the combination of the dual-mode lock and having an outer end;

a knob formed on the outer end; and an inner end.

* * * * *